US006578619B2

(12) United States Patent
Wright

(10) Patent No.: US 6,578,619 B2
(45) Date of Patent: Jun. 17, 2003

(54) OVERHEAD GARAGE DOOR

(75) Inventor: Kevin E. Wright, Dixon, IL (US)

(73) Assignee: Raynor Garage Doors, Dixon, IL (US)

( * ) Notice: Subject to any disclaimer, the term of this patent is extended or adjusted under 35 U.S.C. 154(b) by 0 days.

(21) Appl. No.: 09/862,070

(22) Filed: May 21, 2001

(65) Prior Publication Data

US 2002/0170687 A1 Nov. 21, 2002

(51) Int. Cl.[7] ..... E05D 15/06
(52) U.S. Cl. ..... 160/229.1; 160/232; 160/40
(58) Field of Search ..... 160/229.1, 201, 160/40, 232, 236, 207

(56) References Cited

U.S. PATENT DOCUMENTS

| | | | |
|---|---|---|---|
| 1,530,762 | A | 3/1925 | Dautrick |
| 1,621,669 | A | 3/1927 | Johnson |
| 1,626,844 | A | 5/1927 | Kuhn |
| 1,724,995 | A | 8/1929 | Dautrick |
| 1,750,042 | A | 3/1930 | Hoover |
| 1,827,433 | A | 10/1931 | Kendall |
| 1,888,162 | A | 11/1932 | Eklund |
| 1,990,870 | A | 2/1935 | Kelly |
| 1,994,142 | A | 3/1935 | Madsen |
| 1,995,644 | A | 3/1935 | Miller |
| 2,017,012 | A | 10/1935 | Morgan |
| 2,059,833 | A | 11/1936 | Winn, Jr. |
| 2,093,019 | A | 9/1937 | Norberg |
| 2,099,191 | A | 11/1937 | Blodgett |
| 2,134,397 | A | 10/1938 | Clark |
| 2,166,746 | A | 7/1939 | Bartel |
| 2,557,716 | A | 6/1951 | Allee |
| 2,641,792 | A | 6/1953 | Peeler |
| 2,681,480 | A | 6/1954 | Dixon, Sr. |
| 2,694,234 | A | 11/1954 | Roby et al. |
| 2,817,875 | A | 12/1957 | Harris et al. |
| 2,852,840 | A | 9/1958 | Harvey |
| 2,871,932 | A | 2/1959 | Stroup |
| 2,910,741 | A | 11/1959 | Dettman |
| 2,952,313 | A | 9/1960 | Stroup |
| 3,000,048 | A | 9/1961 | Harsch |
| 3,013,410 | A | 12/1961 | Schmitter |
| 3,104,699 | A | 9/1963 | Wolf et al. |
| 3,160,200 | A | 12/1964 | McKee et al. |
| 3,165,143 | A | 1/1965 | Jackwig |
| 3,198,242 | A | 8/1965 | Crosswell |
| 3,302,690 | A | 2/1967 | Hurd |
| 3,319,697 | A | 5/1967 | Krohn |
| 3,322,586 | A | 5/1967 | Hasenwinkle et al. |
| 3,347,305 | A | 10/1967 | Urbanick |
| 3,359,594 | A | 12/1967 | Pastoor |

(List continued on next page.)

FOREIGN PATENT DOCUMENTS

| | | | |
|---|---|---|---|
| DE | 3814275 | A1 | 2/1993 |
| DE | 3922981 | A1 | 2/1993 |
| DE | G9206018.8 | | 7/1993 |
| DE | 3922995 | A1 | 9/1993 |
| DE | 4227311 | A1 | 2/1994 |
| DE | G9406615.9 | | 9/1994 |
| EP | 0438046 | B1 | 10/1993 |
| EP | 0370324 | B1 | 3/1994 |
| EP | 0370376 | A2 | 7/1994 |
| EP | 0612910 | B1 | 12/1997 |
| WO | WO93/09325 | | 5/1993 |

*Primary Examiner*—David M. Purol
(74) *Attorney, Agent, or Firm*—Banner & Witcoff, Ltd

(57) ABSTRACT

The present invention relates to a pinch-proof garage door for protecting human fingers from being pinched. The garage door includes a plurality of horizontally aligned garage door panels. Each garage door panel has a male portion and a female portion, wherein the male and female portions cooperate with each other to such a manner so as to minimize a gap therebetween. Each garage door panel is removably connected together by a hinge assembly which cooperates with an the garage door panels so as to prevent human fingers from being pinched by the inside of the garage door.

33 Claims, 5 Drawing Sheets

U.S. PATENT DOCUMENTS 3,566,448 A 3/1971 Ernst
3,608,613 A 9/1971 Halliwell
3,635,277 A 1/1972 Bahnsen
3,648,755 A 3/1972 Thiele
3,740,916 A 6/1973 Kenaga
3,869,269 A 3/1975 Knapp
3,891,021 A 6/1975 Geoffrey
3,893,269 A 7/1975 Nelsson et al.
3,934,635 A 1/1976 Kin
3,941,180 A 3/1976 Thill
4,040,142 A 8/1977 Ippolito
4,151,031 A 4/1979 Goad et al.
4,183,393 A 1/1980 Bailey
4,238,544 A 12/1980 Mullet
4,269,253 A 5/1981 Ziegler
4,284,118 A 8/1981 Ceron
4,339,487 A 7/1982 Mullet
4,348,164 A 9/1982 Fujii et al.
4,387,760 A 6/1983 Greschbach
4,472,910 A 9/1984 Iha
4,667,724 A 5/1987 Dragone
4,685,266 A 8/1987 Mullet
4,794,972 A 1/1989 Hormann
4,878,267 A 11/1989 Roach et al.
4,893,666 A 1/1990 Hormann
4,989,660 A 2/1991 Wagner
5,001,862 A 3/1991 Albenda
5,002,114 A 3/1991 Hormann
5,036,899 A 8/1991 Mullet
5,043,128 A 8/1991 Umeda
5,103,890 A 4/1992 Cloutier
5,170,832 A 12/1992 Wagner
5,782,283 A 7/1998 Kendall
5,927,369 A 7/1999 Pedersen FIG.6
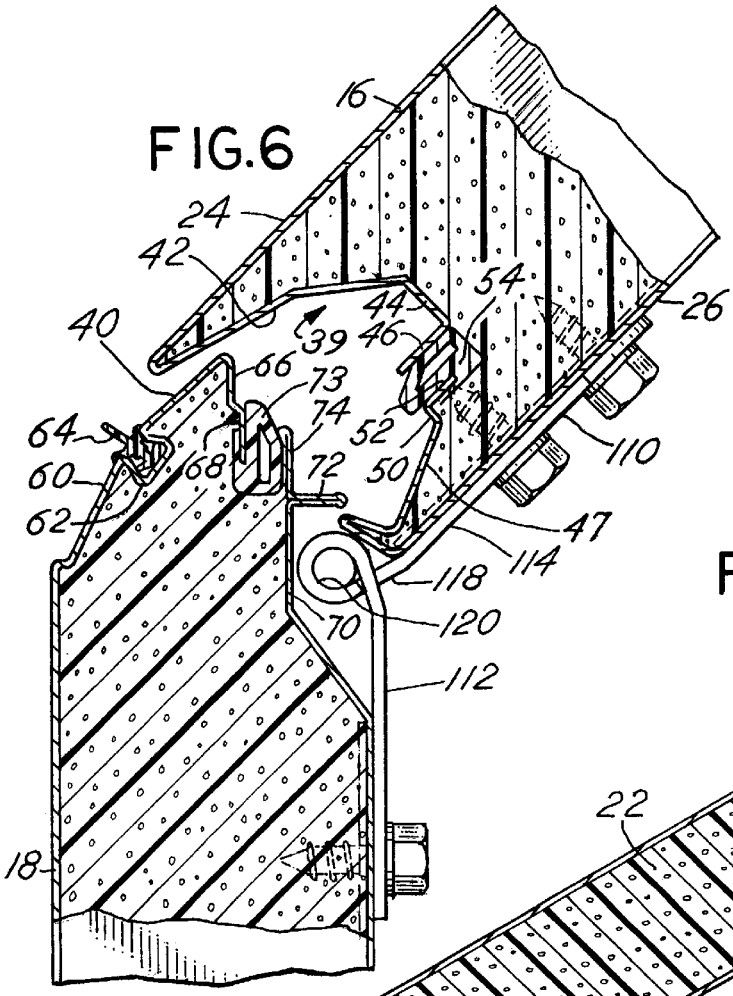
FIG.8
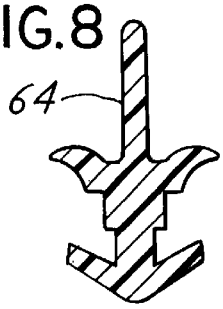
FIG.9
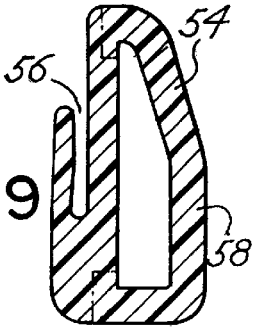
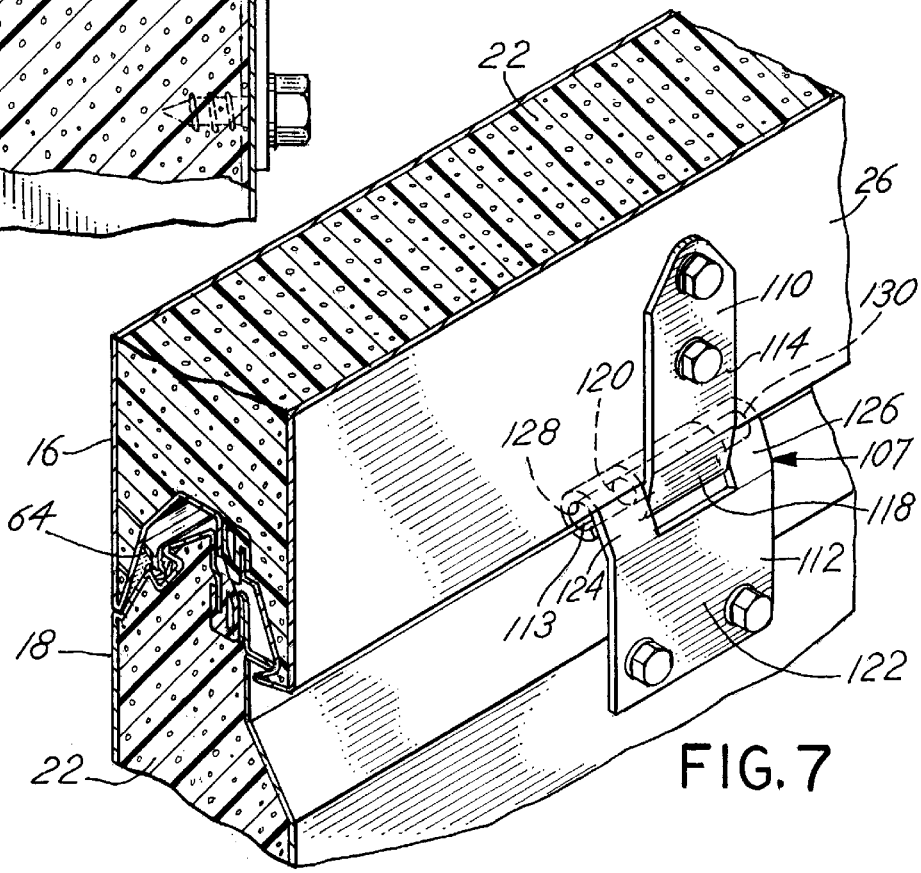
FIG.7

FIG.10
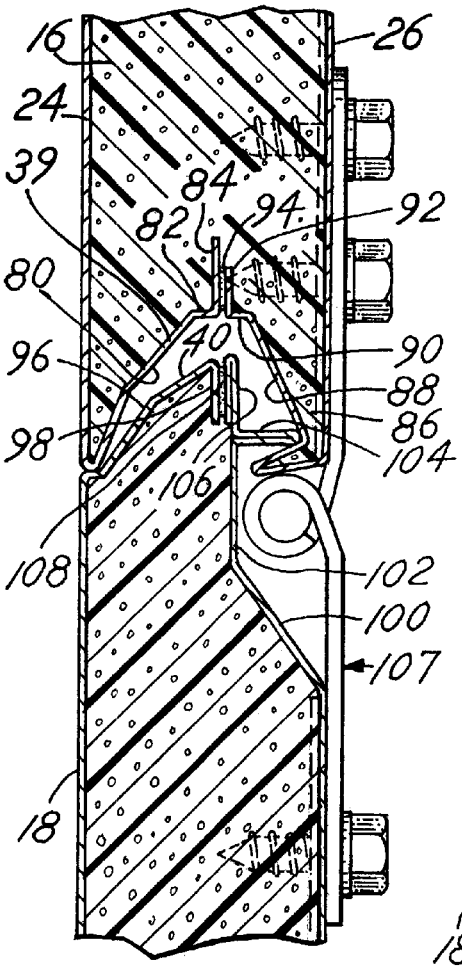
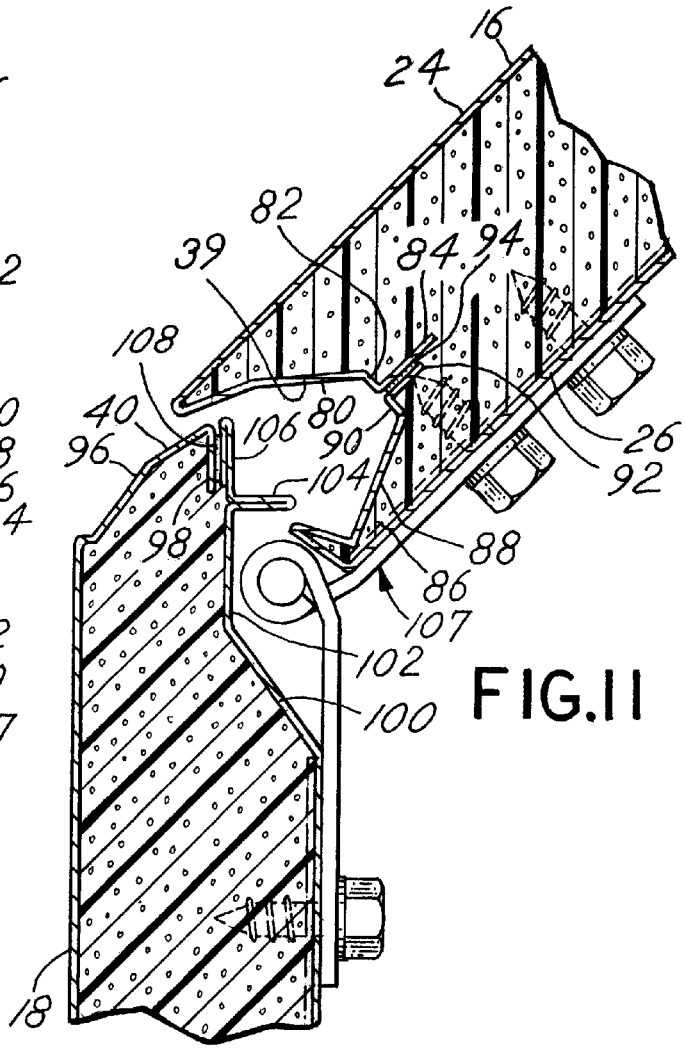
FIG.11

OVERHEAD GARAGE DOOR

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates generally to the field of sectioned or multiple panel garage doors, and more particularly to sectioned, overhead garage doors that eliminate gaps between adjacent hingedly, connected panels forming the door during the full range of articulation of the panels relative to one another, thereby preventing insertion of a finger or finger-shaped object in the junction between panels.

BACKGROUND OF THE INVENTION

Overhead garage doors are commonly constructed from a series of horizontal sections or panels hingedly connected about horizontal axes. The sides of each panel forming the door are typically mounted on a suitable track assembly for movement between a vertical position closing the garage opening, and a horizontal position allowing access to the garage interior. The hinged panels articulate relative to one another about horizontal hinge axes of panel connection to facilitate negotiation of the orientation change between a vertical, closed position and a horizontal, open position. In moving between the vertical and horizontal positions, sizable angular gaps may be formed and then closed between facing positions of horizontal edges of adjacent panels. The formation and closure of such gaps is potentially hazardous. For example, injury may result if a finger is captured in the gap when the door is being closed. Furthermore, the gap may allow entry of rain, snow, dirt, and the like, which might impede operation of the door and obstruct the hinge mechanism. In the wintertime, the gap might permit ice formation between adjacent panels, thus further impeding operation of the garage door.

BRIEF SUMMARY OF THE INVENTION

The present invention includes a garage door having at least one a first, horizontal garage door panel with a female portion, and a second, horizontal garage door panel with an abutting horizontal male portion. The female portion and the male portion are shaped to move through a full range of articulation, without interference, without forming a gap to thereby prevent human fingers from being inserted and pinched between the articulating panels. In an exemplary embodiment of the present invention, the horizontal panels have a foam core sandwiched between metal sheets that form the front side and rear side of the garage door panels. The opposed horizontal male and female portions of the adjacent, horizontal panels are configured with overlapping edges. In operation, the female profile receives the male profile and moves relative to the male profile as the garage door moves through a broad range of articulation. In addition, a hinge assembly connects and cooperates with the horizontal panels so as to prevent human fingers from being pinched between the horizontal panels as the garage door transitions from a closed to an open state.

These as well as other novel advantages, details, embodiments, features, and objects of the present invention will be apparent to those skilled in the art from the following detailed description of the invention, the attached claims and accompanying drawings, listed herein below which are useful in explaining the invention.

The design of the panel edges and connecting hinges precludes development of a large gap between the edges regardless of the articulated position of the adjacent panels.

BRIEF DESCRIPTION OF THE DRAWINGS

Other features, and advantages of the present invention will become apparent from the detailed description of the invention that follows, when considered in light of the accompanying drawings. In the drawings, the figures have the following general nature:

FIG. 6 shows an exemplary embodiment of the present invention, in particular, an enlarged sectional view of an exemplary embodiment of the present, in particular of the horizontal engagement of adjacent garage door panels, when one panel is in a half-open position;

FIG. 7 is an enlarged isometric view of the edge hinge assembly construction;

FIG. 8 depicts a cross-sectional view of an air infiltration seal;

FIG. 9 depicts a cross-sectional view of an thermal joint member;

FIG. 10 shows another exemplary embodiment of the present invention, in particular enlarged sectional view of the horizontal engagement of adjacent garage door panels;

FIG. 11 further depicts the exemplary embodiment of FIG. 10, in particular, an enlarged sectional view of an exemplary embodiment of the present, in particular of the horizontal engagement of adjacent garage door panels, when one panel is in a half-open position.

DETAILED DESCRIPTION OF THE INVENTION

For a better understanding of the present invention, reference may be had to the following detailed description taken in conjunction with the appended claims and accompanying drawings. Briefly, the present invention prevents human fingers or similar items having a diameter in the range of 3 to 5 mm form being inserted into gaps between the front of horizontally adjacent and hinged garage panels and the back of horizontally adjacent and hinged garage door panels.

Figure 1:
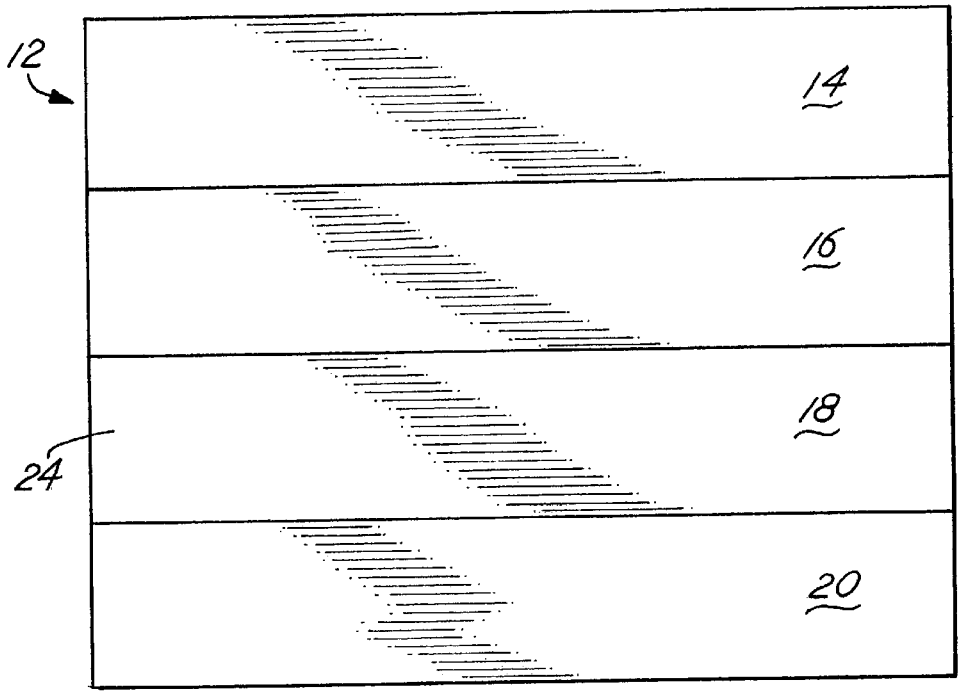
FIG. 1 is front elevation of the outer surface of a closed garage door constructed in accordance with the present invention, and depicts a horizontal orientation of adjacent garage door panels.

Referring to FIG. 1, in an exemplary embodiment of the present invention, a garage door 12 includes a plurality of horizontally, oriented, garage door panels 14, 16, 18, 20. The garage door panels 14, 16, 18, 20 are generally rectangular and are each constructed with a foam core 22 which is preferably made of low density, rigid foam, such as polyurethane foam insulation. The foam core 22 provides structural strength or integrity to the garage door panels and acts as a thermal barrier. In addition, as shown in FIG. 3, the garage door panels 14, 16, 18, 20 each have a front face or front panel sheet section 24 and a back face or back panel sheet section 26 which are preferably constructed of aluminum, steel, stainless steel, or other suitable garage door material for further providing structural strength to the garage door panel.

The garage door panels 14, 16, 18, 20 are connected by hinges at their horizontally adjacent edges. The hinge connection provides for articulation about an axis on or adjacent the back side of the panels forming the garage door. Typically, two or more hinges are utilized to join adjacent panels, though a single hinge connection may be utilized.

Figure 2:
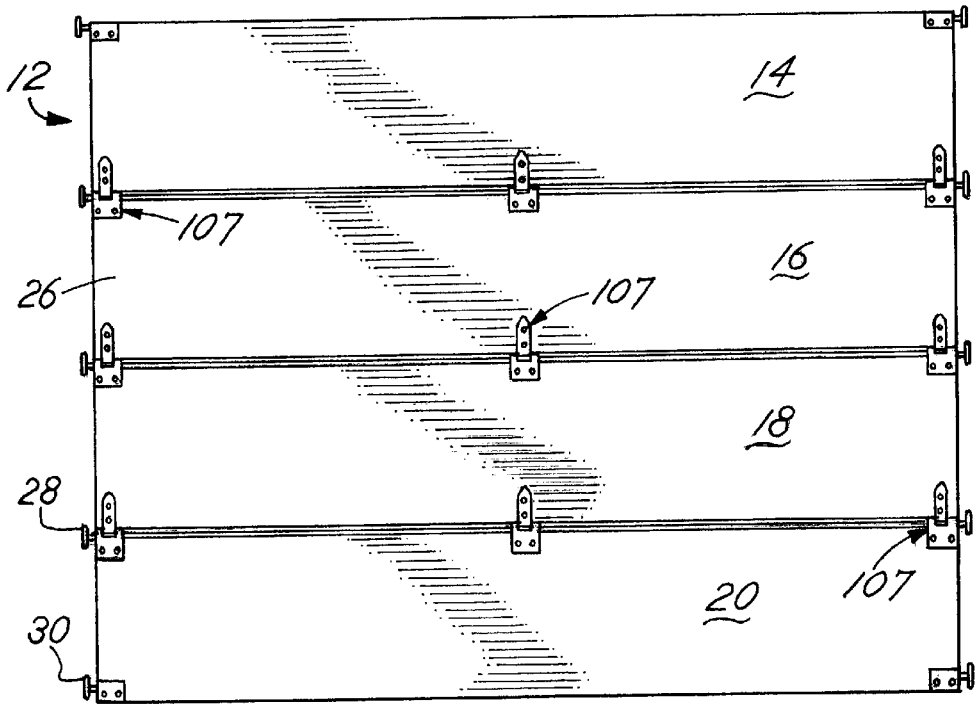
FIG. 2 is rear elevation of the inner surface of a closed garage door, and depicts the inside surface as well as horizontal orientation of adjacent garage door panels.
Figure 3:
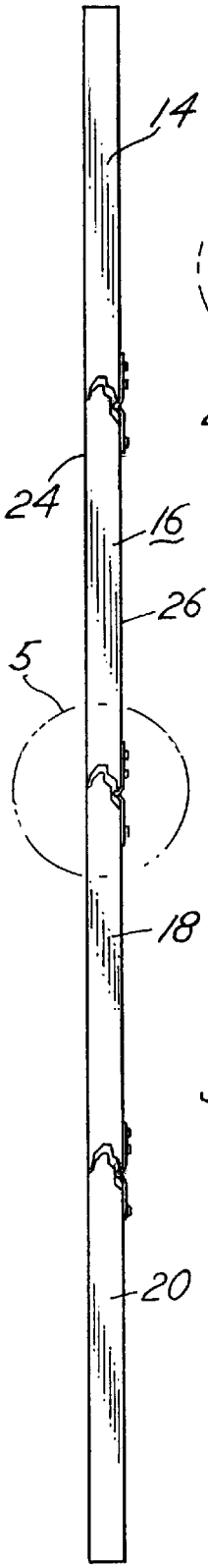
FIG. 3 is a side elevation of the garage door, and more particularly of adjacent garage door panels in a closed position.

Referring to FIG. 3, the garage door panels 14, 16, 18, 20 when in a closed state, are in the same vertical plane and define a relatively flat outer surface. As depicted in the sectional view of FIGS. 3 and 4, the panels 14, 16, 18, 20 are hinged together along the inside or back surface of their adjacent horizontal edges. The sides of each panel include projecting rollers (e.g. 28, 30, FIG. 2) that ride in a track (32 in FIG. 4) on each side of a garage door opening. The track 32 has a vertical run 34 along the door opening connected by an arcuate section 36 to an overhead horizontal run 38. Typically the rollers 28, 30 are co-axial or nearly co-axial with the hinge connection between adjacent horizontal panels. As the multi-paneled garage door opens, the panels 14, 16, 18, 20 articulate about the connecting hinge pins (described in more detail below). As the panels move along the track 32 and articulate relative to one another, the opposed horizontal edges also move relative to one another. The design of the panel edges and connecting hinges precludes development of a large gap between the edges regardless of the articulated position of the adjacent panels, and insertion of a test rod greater than 5 mm diameter into either the front side or back side of the garage door at the hinged joint is not possible or is impeded because of the design.

Specifically, the adjacent, horizontal edges of the garage door panels have opposed male and female profiles which over lie over the other. The female profile 39 defines a pocket that receives the male profile 40 and eliminates gapping through a broad range of articulation. The profiles of these sections are depicted in cross section in FIGS. 5 and 6. The cross sectional profiles are generally uniform along the horizontal edges, but maybe varied within the scope of the invention. The female profile 39 includes a generally arcuate section 42 commencing at the front face or front panel sheet section 24 of the upper panel 16. The arcuate section 42 may form a concave arc of a circle or other curved surface relative to the bottom female profile 39 or may be in the form of a plurality of connected polygon sections. This arcuate section 42 flows into a generally flat, horizontal section 44, and in turn, the horizontal section 44 flows into and perpendicularly abuts a vertical run 46. The female profile further includes a female finger extension or an overlapping rib 45 commencing at the back face or back panel sheet section 26 of the upper panel 16. The female finger extension or overlapping rib 45 flows into a planar section 47, and in turn, the planar section 47 flows into a generally flat, horizontal section 50. The horizontal section 50 flows into and perpendicularly abuts a generally flat, vertical section 52. A thermal joint member 54 is constructed of an elostomeric material and connects to the vertical section 52. Specifically, the thermal joint member 54 includes a retaining channel 56 for receiving the vertical section 52. The thermal joint member 54 further includes a body portion 58 that contacts the vertical run 46. The thermal joint member 54 extends horizontally along the length of horizontal edge of the garage door and serves as a thermal barrier between the vertical section 52 and the vertical run 46. Preferably, the thermal retaining channel 56 of the thermal joint member 54 is constructed of rigid poly vinyl chloride (PVC) and the body portion 58 is constructed of flexible PVC. In construction, the rigid and flexible PVC are co-extruded to form the thermal joint member 54. Such methods of co-extrusion are known by those skilled in the art. The thermal joint member 54 is a thermal insulating, nonconductive member which serves to thermally insulate the front panel sheet section from the back panel sheet section.

The male profile 40 includes a generally arcuate section 60 commencing at the front face or front panel sheet section 24 of the lower panel 18. This arcuate section 60 may form a concave arc of a circle or other curved surface relative to the top male profile 40 or may be in the form of a plurality of connected polygon sections. This arcuate section 60 includes a dovetail defining an air seal member section 62 that extends horizontally along the horizontal edge of the garage door. Seated in the air seal member section 62 is an infiltration seal 64 which also extends horizontally along the horizontal edge of the garage door. Preferably, the infiltration seal 64 is constructed of extruded ethylene propylene diene monomer (EPDM) rubber. The infiltration seal 64 fits against the female arculate section 42 and creates a barrier that prevents air, water, snow, and the like from coming thought the section joint. Furthermore, the infiltration seal 64 serves to wipe or remove water, snow, dirt and the like from the arcuate section 42 as the garage door panels 16, 18 articulate with respect to one another.

The arcuate section 60 of the male profile 40 flows into a generally flat, vertical section 66, and in turn, the vertical section 66 flows into a transition section 68. A thermal joint member 73, as described in detail above, connects to the transition segment 68. The male profile further includes a planar section 69 extending from the back face or back panel sheet section 26 of the lower panel 18. The planar section 69 flows into a generally flat, vertical section 70. A horizontal radial run extension or rearwardly projecting rib 72 extends toward the back face or back panel sheet section 26. A vertical radial run 74 extends from and perpendicularly abuts the horizontal radial run extension or rearwardly projecting rib 72. The vertical radial run 74 contacts the thermal joint member 73, thereby providing a thermal seal between the vertical radial run 74 and the transition section 68. The thermal joint member 73 is a thermal insulating, non-conductive member which serves to thermally insulate the front panel sheet section from the back panel sheet section. Furthermore, when the garage door panels 14, 16, 18, 20 are in the closed position or in a co-planar array, the thermal joint members 54, 73 engage each other and seal the passage along the joint between adjacent garage door panels.

Figure 4:
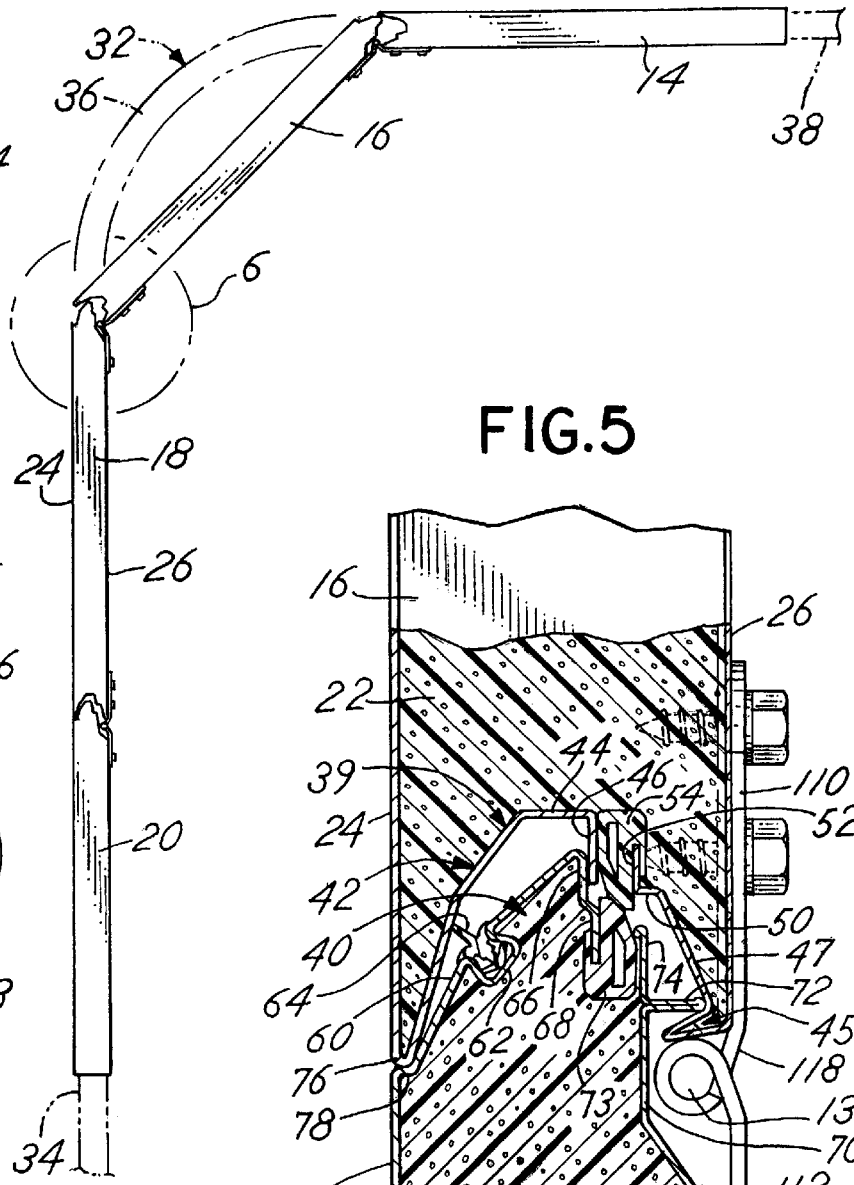
FIG. 4 is a side elevation of the garage door in a half-open position, with one garage door panel horizontally disposed, one garage door panel in an angled position, and two garage door panels vertically aligned.
Figure 5:
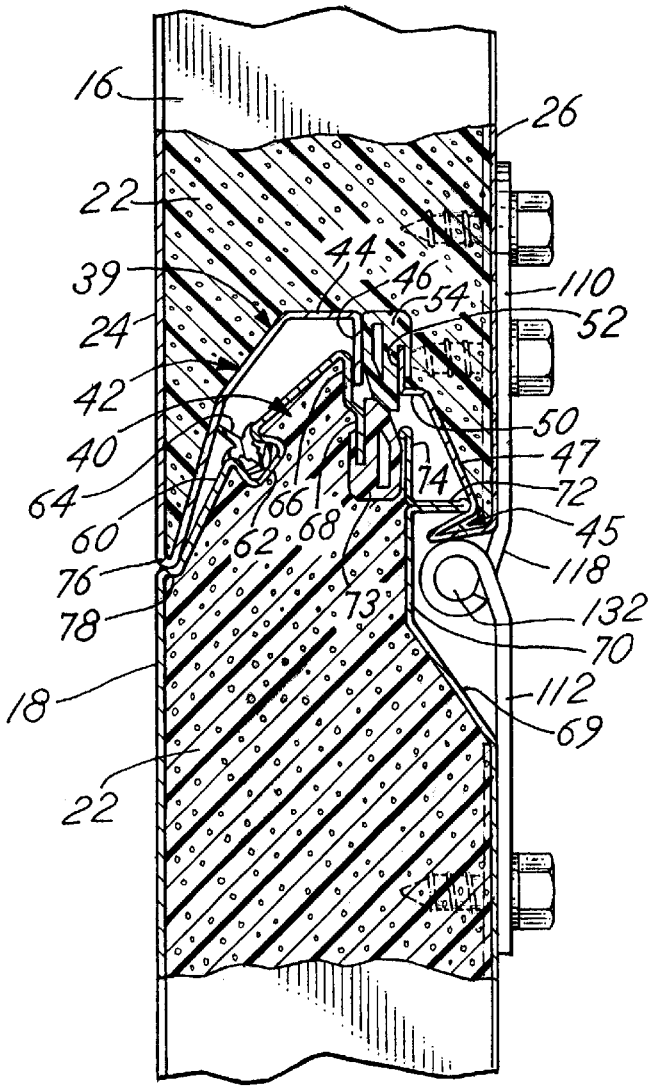
FIG. 5 shows an exemplary embodiment of the present invention, in particular, an enlarged sectional view of the horizontal engagement of adjacent garage door panels.

Referring to FIGS. 5 and 6, garage door panels 16 and 18 are illustrated with the door panel 16 having a shaped bottom female portion 38 and door panel 18 having a shaped top male portion 40 in the door closed position or the fully open position. Each garage door panel 14, 16, 18, 20 includes a shaped bottom female portion 38 and a shaped top male portion 40. In use, the bottom female portion 38 of a first garage door panel 16 cooperatively relates to the top male portion 40 of a second garage door panel 18 in such a manner so as to prevent insertion of a finger into a gap between the two panels 16, 18 regardless of the relative articulation of the panels 16, 18 as they move along the side tracks as illustrated in FIGS. 3 and 4.

Referring to FIG. 5, door panels 16 and 18, in a closed position, contact each other at the point where a rounded corner 76 of the door panel 16 engages a transition segment 78 of door panel 18. Along the back side, there is no gap between the horizontal radial run extension or rearwardly projecting rib 72 and the female finger extension or overlapping rib 45. Thus, there is not gap between panels 16 and 18 when the door panels are in a closed position. Advantageously, no human fingers can be pinched when the door panels are in a closed position.

FIGS. 10 and 11 depict a second exemplary embodiment of the present invention. Specifically, the female profile 38 includes a generally arcuate section 80 commencing at the front face or front panel sheet section 24 of the upper panel 16. The arcuate section 80 may form a concave arc of a circle or other curved surface relative to the bottom female profile 38 or may be in the form of a plurality of connected polygon sections. This arcuate section 80 flows into a generally flat, horizontal section 82, and in turn, the horizontal section 82 flows into and perpendicularly abuts a vertical run 84. The female profile further includes a female finger extension or overlapping rib 86 commencing at the back face or back panel sheet section 26 of the upper panel 16. The female finger extension or overlapping rib 86 flows into a planar section 88, and in turn, the planar section 88 flows into a generally flat, horizontal section 90. The horizontal section 90 flows into and perpendicularly abuts a generally flat, vertical section 92. A thermal joint member 94 is located between the vertical run 84 and the vertical section 92. Preferably, the thermal joint member 94 is an extruded urethane gasket that extends horizontally along the horizontal length of the garage door panel. The thermal joint member 94 may be constructed of urethane glue, foamed urethane, or other suitable materials. The thermal joint member 94 provides a thermal seal between the vertical run 84 and the vertical section 92.

The male profile 40 of the second exemplary embodiment includes a generally arcuate section 96 commencing at the front face or front panel sheet section 24 of the lower panel 18. This arcuate section 96 may form a concave arc of a circle or other curved surface relative to the top male profile 40 or may be in the form of a plurality of connected polygon sections. This arcuate section 96 flows into a generally flat, vertical section 98. The male profile 40 further includes a planar section 100 extending from the back face or back panel sheet section 26 of the lower panel 18. The planar section 100 flows into a generally flat, vertical section 102. A horizontal radial run extension or rearwardly projecting rib 104 extends toward the back face 26. A vertical radial run 106 extends from and perpendicularly abuts the horizontal radial run extension or rearwardly projecting rib 04. A thermal joint member 108 is located between the vertical section 98 and the vertical radial run 106. Preferably, the thermal joint member 108, as shown in FIG. 8, is an extruded urethane gasket that extends horizontally along the horizontal length of the garage door panel. The thermal joint member 108 may be constructed of urethane glue, foamed urethane, or other suitable materials. The thermal joint member 108 provides a thermal seal between the vertical section 98 and the vertical radial run 106.

FIG. 7 depicts a horizontal hinge assembly 107 for the present invention. The hinge assembly 107 includes an upper leaf 110, a lower leaf 112, and a hinge pin 113. The upper leaf 110 has a fastening portion 114 that is removably fastened to the garage door panel 16 by screws, rivets, or other suitable fasteners. The upper leaf 110 further has an angled hinge portion 118 extending from the plane of the fastening portion 114. The angled hinge portion 118 forms a substantially cylindrical hole 120 horizontally extending the width of the angled hinge portion 118. The lower leaf 112 includes a broad central leaf member 122 that is removably fastened to the lower panel 18 by screws, rivets, or other suitable fasteners. The lower leaf further includes upstanding outwardly extending opposed flanges 124 and 126 having keyed openings 128 and 130 defined in the flanges 124 and 126. The flanges 124 and 126 are horizontally aligned with the cylindrical hole 120 of the upper leaf 110. The hinge pin 113 extends through the flanges 124 and 126 of the lower leaf and the cylindrical hole 120 to operatively couple the upper leaf 110 with the lower leaf 112. Thus, the hinge pin 113 removably connects the door panel 16 with the door panel 18 and allows the door panels 16, 18 to pivot relative to one another about the hinge pin 113 as the garage door 12 transitions from a closed to an open state. Furthermore, the hinge assembly 107 cooperates with the garage door panels 16, 18 so as to prevent human fingers from being pinched between garage door panels 16, 18 as the garage door 12 transitions from a closed to an open state.

Figure 12:
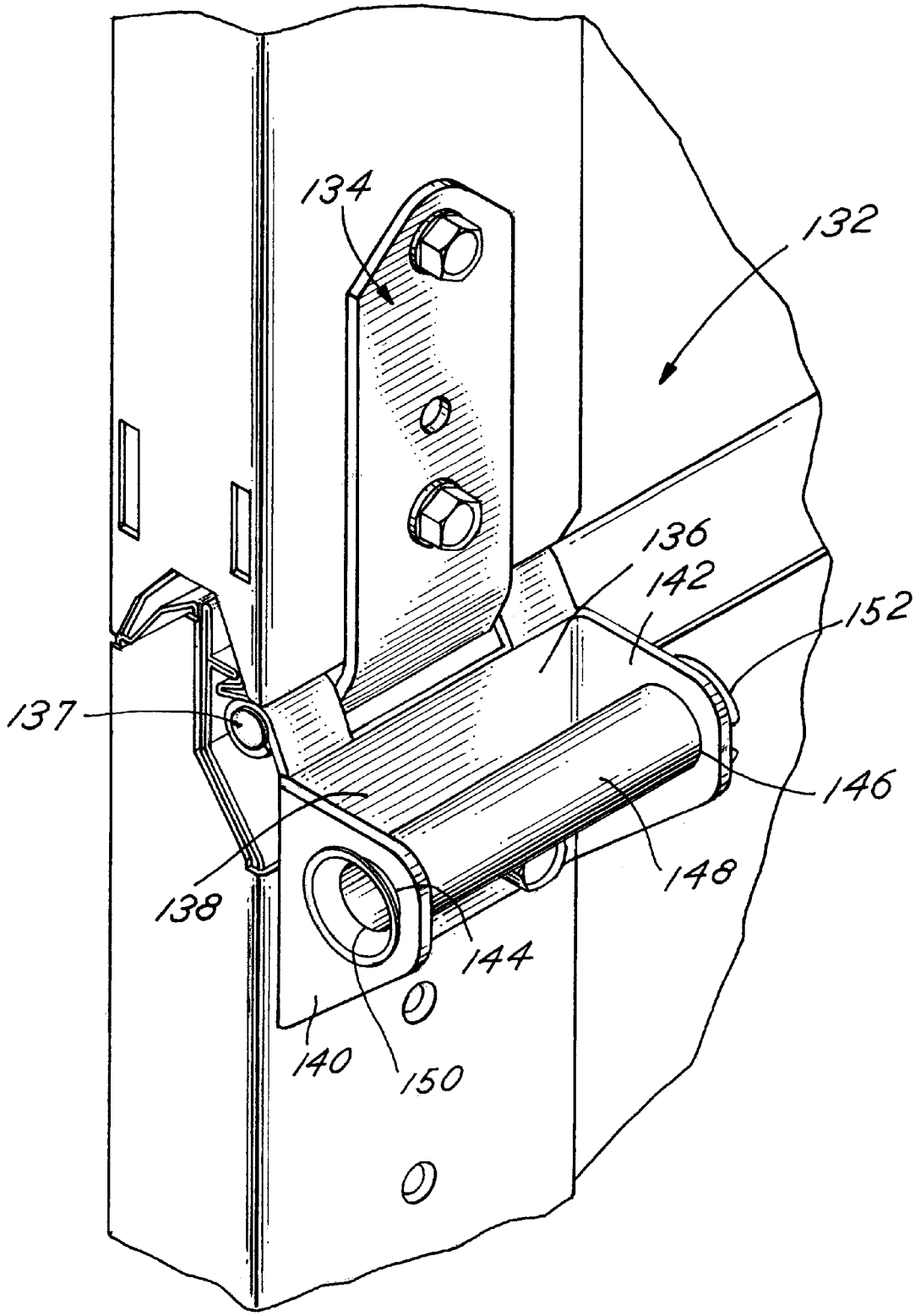
FIG. 12 is an isometric view of a door panel edge hinge assembly of the present invention.

Referring to FIG. 12, there is depicted the construction of an edge hinge assembly 132. The edge hinge assembly 132 includes an upper leaf 134 and a lower leaf 136. A hinge pin 137 connects the upper leaf 134 and the lower leaf 136. The lower leaf 134 has a configuration substantially like that of the upper leaf 110. The lower leaf 136 has a distinctive or different configuration. The lower leaf 136 includes a broad central leaf member 138, upstanding outwardly extending opposed flanges 140, 142 and having cylindrical openings 144, 146 defined in the flanges 140, 142. A cylindrical sleeve 148 with two opposing cylindrical holes 150, 152 aligns within the cylindrical openings 144, 146. A shaped track roller is mounted on a cylindrical shaft or rod which fits within the cylindrical sleeve 148 and is retained so that that the hinge assembly 132, in combination with the roller and associated shaft, supports the door on the track.

In the foregoing specification, the present invention has been described with reference to specific exemplary embodiments thereof. It will be apparent to those skilled in the art, that a person understanding this invention ma conceive of changes or other embodiments or variations, which utilize the principles of this invention without departing from the broader spirit and scope of the invention. The specification and drawings are, therefore, to be regarded in an illustrative rather restrictive sense. Accordingly, it is not intended that the invention be limited except as may be necessary in view of the appended claims.

I claim:

1. In a multiple panel door construction comprising in combination:

at least first and second adjacent articulated door panels, the panels hinged together at a hinge joint about an axis and including opposed edges at the hinge joint, the panels each including a front panel sheet section and a back panel sheet section with a connecting edge section provided at the edges of each respective panel, the opposed edges being configured to provide an opposed male and female shape in cross section to provide finger protection: the improvement comprising, a thermally insulating, non-conductive member interposed along each edge of the opposed edges and located between the front and back panel sections, the front and back panel sections being thereby separately thermally insulated one from the other;

a front side panel protection including a lower edge female shape formed in the front panel sheet in opposed to an upper edge male shape formed in the front panel sheet of the adjacent panel; and a back side panel protection including a depending overlapping rib formed in the lower edge of the back panel sheet and a rearwardly projecting rim formed in the upper edge of the back panel sheet, whereby the overlapping rib extends into a gap between the hinge joint and the rearwardly projecting rib when the door panels are in a closed position.

2. The improvement of claim 1 wherein the non-conductive members are positioned in each respective, opposed edge for engagement when the adjacent panels are in co-planar array.

3. The improvement of claim 2 wherein the non-conductive members are configured to engage and distort in opposite directions when the adjacent panes are in coplanar array.

4. The improvement of claim 1 where in the non-conductive members engage to seal the passage along the joint between adjacent panels when the adjacent panels are co-planar.

5. The improvement of claim 1 where in the panels are connected by the hinge for articulation about the back side of the panels.

6. The improvement of claim 1 wherein at least one edge of one panel includes a flexible wiper blade projecting from the edge for engaging the opposed edge of the next adjacent panel when the panels are in the closed position.

7. The improvement of claim 6 further comprising a wiper blade mounted in the male shaped edge and projects therefrom for engagement with the female shaped edge.

8. The improvement of claim 1 wherein the thermally insulating member is an elastomeric material.

9. The improvement of claim 1 wherein the thermally insulating member comprises an elastomeric member including a face portion, said face portion projecting outwardly from the respective edges in the door closed position.

10. The improvement of claim 1 wherein the adjacent panels are in contact in the open position only by means of a hinge assembly affixed to respective back panel sections and are in contact in the closed position only by means of the hinge assembly affixed to back panel sections and by touching contact of the front panel sections, whereby all of the front and back panel sections are thermally insulated from each other.

11. The improvement of claim 1 wherein the region between the front panel section and back panel section is comprised of an insulating material.

12. The improvement of claim 1 wherein the front panel section and back panel section are comprised of formed sheet metal.

13. The improvement of claim 1 wherein the front panel section or back panel section or both panel sections are formed sheet metal.

14. The improvement of claim 1 wherein the front panel section is configured with a decorative patern.

15. The improvement of claim 1 wherein the back panel section is planar.

16. The improvement of claim 1 wherein the adjacent panels are joined by a hinge assembly having an axis of rotation substantially coplainer with the back panel sections and further including a back panel section extension of one said panels overlapping a back panel section extension of the adjacent panel where by upon articulation of said panels from a straight angle to a lesser angle, the extension remain in overlapping configuration to provide finger protection for the back panel sections.

17. The pinch proof garage door of claim 1 wherein the first garage door panel and the second garage door panel are horizontally oriented.

18. The pinch proof garage door of claim 1 further comprising a hinge assembly comprising:

an upper leaf coupled to the first door panel, the upper leaf having a substantially cylindrical hole;

a lower leaf coupled to the second door panel, the lower leaf having two opposed horizontally-aligned holes, aligned with the substantially cylindrical hole of the upper leaf; and a hinge pin operatively coupling the upper leaf with the lower leaf, the hinge pin extending through the two opposed horizontally-aligned holes of the lower leaf and the substantially cylindrical hole of the upper leaf, whereby the first door panel and the second door panel pivot relative to one another about the hinge pin as the garage door transitions form a closed to an open state.

19. A multiple panel door construction comprising, in combination:

a hinge joint;

at least first and second adjacent articulated door panels, said panels hinged together by the hinge joint about an axis and including opposed edges at the hinge joint, said panels each including a front panel sheet section and a back panel sheet section with a connecting edge section provided at the edges of each respective panel, the opposed edges being configured to provide an opposed male and female shape in cross section to provide finger protection, said finger protection configuration including a front side panel protection including a lower edge female shape formed in the front panel sheet in opposed to an upper edge male shape formed in the front panel sheet of the adjacent panel, and a back side panel protection including a depending overlapping rib formed in the lower edge of the back panel sheet, said rib overlapping a rearwardly projecting rim formed in the upper edge of the back panel sheet of the adjacent panel, whereby the overlapping rib extends into a gap between the rearwardly projecting rim and the hinge joint; and a thermally insulating, non-conductive member interposed along each edge of the opposed edges and located between the front and back panel sections, said front and back panel sections being thereby separately thermally insulated one from the other.

20. A pinch proof garage door for protecting human fingers from being pinched, the pinch proof garage door comprising, in combination:

a first garage door panel having a female portion, the female portion including a female thermal joint member;

a second garage door panel having a male portion having a male thermal joint member and an air infiltration seal, the male portion of the second garage door panel cooperating with the female portion of the first garage door panel, the male portion and the female portion shaped so as to prevent the human fingers from being pinched;

a hinge assembly hingedly connecting the first garage door panel with the second garage door panel, the garage door panels having an axis of rotation about a hinge pin;

an overlapping rib formed on a back section of the first garage door panel;

a rearwardly projecting rim formed on a back section of the second garage door panel, whereby the overlapping rib formed extends into gap between the rearwardly projecting rib and the hinge pin when the garage door panels are in closed position.

21. A pinch proof garage door for protecting human fingers from being pinched, the pinch proof garage door comprising:

a first horizontal door panel having a horizontal edge, a front face, and a back face;

a first female portion located the horizontal edge of the panel, the first female portion shaped so as to include:

a female arcuate segment extending up from a front face of the horizontal panel, a first female horizontally disposed straight segment abutting the first female arcuate segment, a first female vertically disposed straight segment perpendicularly abutting the first female horizontally disposed straight segment, a female finger segment extending from the back face of the first horizontal panel, a female planar segment abutting the female finger segment, a second female horizontally disposed straight segment abutting the female planar segment, a second female vertically disposed straight segment perpendicularly abutting the second female horizontally disposed straight segment, a female thermal joint member member coupled to the second female vertically disposed straight segment and contacting the first female vertically disposed straight segment, the female thermal joint member member extending horizontally along the length of the horizontal panel thereby providing a thermal seal between the first female vertically disposed straight segment and the second vertically disposed vertical segment; and a second horizontal door panel with a horizontal edge, a front face and a back face, the second horizontal panel opposed to the horizontal edge of the first panel;

a first male portion located on the second horizontal panel edge, the first male portion shaped so as to include:

a male arcuate segment extending from the front face of the horizontal panel, an air seal member receiving section in the male arcuate section, the air seal member receiving section containing an air infiltration seal extending horizontally along the length of the horizontal panel, a first male vertically disposed segment abutting the male arcuate segment, a male transition segment abutting the first male vertically disposed segment, a second male vertically disposed segment abutting the male transition segment, a first male planar section extending up from a rear face of the second horizontal panel, a third male vertically disposed segment abutting and extending up from the first male planar segment, a horizontally disposed radial run perpendicularly abutting the third male vertically disposed segment, wherein the horizontally disposed radial run extends back toward the rear face of the of the second horizontal panel, and a vertically disposed radial run abutting the horizontally disposed radial run, a male thermal joint member member coupled to the second male vertically disposed straight segment and contacting the vertically disposed radial run, the male thermal joint member member extending horizontally along the length of the second horizontal panel, thereby providing a thermal seal between the second male vertically disposed segment and the vertically disposed radial run.

22. A pinch proof garage door for protecting human fingers from being pinched, the pinch proof garage door comprising:

a first horizontal panel having a bottom female portion, the bottom female portion shaped to include:

a female arcuate segment extending up from a front face of the first horizontal panel, a first female horizontally disposed straight segment abutting the first female arcuate segment, a first female vertically disposed straight segment perpendicularly abutting the first female horizontally disposed straight segment, a female finger segment extending from a back face of the first horizontal panel, a female planar segment abutting the female finger segment, a second female horizontally disposed straight segment abutting the female planar segment, a second female vertically disposed straight segment perpendicularly abutting the second female horizontally disposed straight segment, a female thermal joint member coupled to the second female vertically disposed straight segment and contacting the first female vertically disposed straight segment, the female thermal joint member extending horizontally along the length of the first horizontal panel, thereby providing a thermal seal between the first female vertically disposed straight segment and the second vertically disposed vertical segment;

a second horizontal panel having a top male portion cooperating with the bottom female portion of the first horizontal panel, the bottom male portion shaped to include:

a male arcuate segment extending from a front face of the second horizontal panel, an air seal locater section in the male arcuate section, wherein the air seal locater section contains an air infiltration seal extending horizontally along the length of the second horizontal panel, a first male vertically disposed segment abutting the male arcuate segment, a male transition segment abutting the first male vertically disposed segment, a second male vertically disposed segment abutting the male transition segment, a first male planar section extending up from a rear face of the second horizontal panel, a third male vertically disposed segment abutting and extending up from the first male planar segment, a horizontally disposed radial run perpendicularly abutting the third male vertically disposed segment, wherein the horizontally disposed radial run extends back toward the rear face of the of the second horizontal panel, and a vertically disposed radial run abutting the horizontally disposed radial run;

a male thermal joint member coupled to the second male vertically disposed straight segment and contacting the vertically disposed radial run, the male thermal joint member extending horizontally along the length of the second horizontal panel, thereby providing a thermal seal between the second male vertically disposed segment and the vertically disposed radial run; and a hinge assembly hingedly connecting the first garage door panel to the second garage door panel.

23. A pinch proof garage door for protecting human fingers from being pinched, the pinch proof garage door comprising:

a first horizontal panel having a bottom female portion, the bottom female portion shaped to include the first female portion shaped so as to include:

a female arcuate segment extending up from a front face of the first horizontal panel, a first female horizontally disposed straight segment abutting the first female arcuate segment, a first female vertically disposed straight segment perpendicularly abutting the first female horizontally disposed straight segment, a female finger segment extending from a back face of the first horizontal panel, a female planar segment abutting the female finger segment, a second female horizontally disposed straight segment abutting the female planar segment, a second female vertically disposed straight segment perpendicularly abutting the second female horizontally disposed straight segment, a female thermal joint member having a retaining channel for receiving the second female vertically disposed straight segment, the female thermal joint member having a body portion contacting the first female vertically disposed straight segment, the female thermal joint member extending horizontally along the length of the first horizontal panel, thereby providing a thermal seal between the first female vertically disposed straight segment and the second female vertically disposed vertical segment;

a second horizontal panel having a top male portion cooperating with the bottom female portion of the first garage door panel, the bottom male portion shaped to include:

a male arcuate segment extending from a front face of the second horizontal panel, an air seal locater section in the male arcuate section, wherein the air seal locater section contains an air infiltration seal extending horizontally along the length of the second horizontal panel, a first male vertically disposed segment abutting the male arcuate segment, a male transition segment abutting the first male vertically disposed segment, a second male vertically disposed segment abutting the male transition segment, a first male planar section extending up from a rear face of the second horizontal panel, a third male vertically disposed segment abutting and extending up from the first male planar segment, a horizontally disposed radial run perpendicularly abutting the third male vertically disposed segment, wherein the horizontally disposed radial run extends back toward the rear face of the of the second horizontal panel, and a vertically disposed radial run abutting the horizontally disposed radial run, a male thermal joint member having a retaining channel for receiving the second male vertically disposed straight segment, the male thermal joint member having a body portion contacting the vertically disposed radial run, the male thermal joint member extending horizontally along the length of the second horizontal panel, thereby providing a thermal seal between the second male vertically disposed straight segment and the vertically disposed radial run;

an upper leaf coupled to the first garage door, the upper leaf having a substantially cylindrical hole;

a lower leaf coupled to the second garage door, the lower leaf having to two opposed horizontally-aligned holes, aligned with the substantially cylindrical hole of the upper leaf; and a hinge pin operatively coupling the upper leaf with the lower leaf, the hinge pin extending through the two opposed horizontally-aligned holes of the lower leaf and the substantially cylindrical hole of the upper leaf, whereby the first garage door panel and the second garage door panel pivot relative to one another about the hinge pin as the garage door transitions form a closed to an open state.

24. A pinch proof garage door for protecting human fingers from being pinched, the pinch proof garage door comprising:

a first horizontal door panel having:

a first female portion located on the first horizontal panel, the first female portion shaped so as to include:

a female arcuate segment extending up from a front face of first the horizontal panel, a first female horizontally disposed straight segment abutting the first female arcuate segment, a first female vertically disposed straight segment perpendicularly abutting the first female horizontally disposed straight segment, a female finger segment extending from a back face of the first horizontal panel, a female planar segment abutting the female finger segment, a second female horizontally disposed straight segment abutting the female planar segment, a second female vertically disposed straight segment perpendicularly abutting the second female horizontally disposed straight segment, a first thermal joint member contacting the second female vertically disposed straight segment and the first female vertically disposed straight segment, the first thermal joint member extending horizontally along the length of the first horizontal panel thereby providing a thermal seal between the first female vertically disposed straight segment and the second vertically disposed vertical segment; and a second horizontal door panel having:

a first male portion located on the second horizontal panel, the first male portion shaped so as to include:

a male arcuate segment extending from a front face of the second horizontal panel, a first male vertically disposed segment abutting the male arcuate segment, a first male planar section extending up from a rear face of the second horizontal panel, a second male vertically disposed segment abutting and extending up from the first male planar segment, a horizontally disposed radial run perpendicularly abutting the third male vertically disposed segment, wherein the horizontally disposed radial run extends back toward the rear face of the of the second horizontal panel, and a vertically disposed radial run abutting the horizontally disposed radial run, a second thermal joint member contacting the second male vertically disposed straight segment and the vertically disposed radial run, the second thermal joint member extending horizontally along the length of the second horizontal door, thereby providing a thermal seal between the second male vertically disposed segment and the vertically disposed radial run.

25. A pinch proof garage door for protecting human fingers from being pinched, the pinch proof garage door comprising:

a first horizontal panel having a bottom female portion, the bottom female portion shaped to include:

a female arcuate segment extending up from a front face of the first horizontal panel, a first female horizontally disposed straight segment abutting the first female arcuate segment, a first female vertically disposed straight segment perpendicularly abutting the first female horizontally disposed straight segment, a female finger segment extending from a back face of the first horizontal panel, a female planar segment abutting the female finger segment, a second female horizontally disposed straight segment abutting the female planar segment, a second female vertically disposed straight segment perpendicularly abutting the second female horizontally disposed straight segment, a first thermal joint member contacting the second female vertically disposed straight segment and the first female vertically disposed straight segment, the first thermal joint member extending horizontally along the length of the first horizontal panel, thereby providing a thermal seal between the first female vertically disposed straight segment and the second vertically disposed vertical segment;

a second horizontal panel having a top male portion cooperating with the bottom female portion of the first horizontal panel, the bottom male portion shaped to include:

a male arcuate segment extending from a front face of the second horizontal panel, a first male vertically disposed segment abutting the male arcuate segment, a first male planar section extending up from a rear face of the second horizontal panel, a second male vertically disposed segment abutting and extending up from the first male planar segment, a horizontally disposed radial run perpendicularly abutting the third male vertically disposed segment, wherein the horizontally disposed radial run extends back toward the rear face of the of the second horizontal panel, and a vertically disposed radial run abutting the horizontally disposed radial run;

a second thermal joint member contacting the second male vertically disposed straight segment and the vertically disposed radial run, the second thermal joint member extending horizontally along the length of the second horizontal panel, thereby providing a thermal seal between the second male vertically disposed segment and the vertically disposed radial run; and a hinge assembly hingedly connecting the first garage door panel to the second garage door panel.

26. A pinch proof garage door for protecting human fingers from being pinched, the pinch proof garage door comprising:

a first horizontal panel having a bottom female portion, the bottom female portion shaped to include the first female portion shaped so as to include:

a female arcuate segment extending up from a front face of the first horizontal panel, a first female horizontally disposed straight segment abutting the first female arcuate segment, a first female vertically disposed straight segment perpendicularly abutting the first female horizontally disposed straight segment, a female finger segment extending from a back face of the first horizontal panel, a female planar segment abutting the female finger segment, a second female horizontally disposed straight segment abutting the female planar segment, a second female vertically disposed straight segment perpendicularly abutting the second female horizontally disposed straight segment, a first thermal joint member being a urethane gasket extruded between the first female vertically disposed straight segment and the second female vertically disposed straight segment, the first thermal joint member extending horizontally along the length of the first horizontal panel, thereby providing a thermal seal between the first female vertically disposed straight segment and the second female vertically disposed vertical segment;

a second horizontal panel having a top male portion cooperating with the bottom female portion of the first garage door panel, the bottom male portion shaped to include:

a male arcuate segment extending from a front face of the second horizontal panel, a first male vertically disposed segment abutting the male arcuate segment, a first male planar section extending up from a rear face of the second horizontal panel, a third male vertically disposed segment abutting and extending up from the first male planar segment, a horizontally disposed radial run perpendicularly abutting the third male vertically disposed segment, wherein the horizontally disposed radial run extends back toward the rear face of the of the second horizontal panel, and a vertically disposed radial run abutting the horizontally disposed radial run, a second thermal joint member being a urethane gasket extruded between the second male vertically disposed straight segment and the vertically disposed radial run, the second thermal joint member extending horizontally along the length of the second horizontal panel, thereby providing a thermal seal between the second male vertically disposed straight segment and the vertically disposed radial run;

an upper leaf coupled to the first garage door, the upper leaf having a substantially cylindrical hole;

a lower leaf coupled to the second garage door, the lower leaf having to two opposed horizontally-aligned holes, aligned with the substantially cylindrical hole of the upper leaf; and a hinge pin operatively coupling the upper leaf with the lower leaf, the hinge pin extending through the two opposed horizontally-aligned holes of the lower leaf and the substantially cylindrical hole of the upper leaf, whereby the first garage door panel and the second garage door panel pivot relative to one another about the hinge pin as the garage door transitions form a closed to an open state.

27. In a multiple panel door construction comprising in combination:

a first and second adjacent garage door panels, the garage door panels hinged together by a hinge assembly having an axis of rotation about a hinge joint, the garage door panels including a front sheet section and a back sheet section, a core region located between the front sheet section and the back sheet section, the front sheet section and the back sheet section defining an upper horizontal edge surface and a lower horizontal edge surface, the upper horizontal edge surface including a male shape formed in the front sheet section and rearwardly projecting rim formed in the back panel section, the lower horizontal edge surface including a female shape formed in the front sheet section and an overlapping rib formed in the back panel sheet section, whereby the overlapping rib extends into a gap between the rearwardly projecting rim and the hinge joint when the garage door panels are in a closed position.

28. The multiple panel door construction of claim 24 wherein the adjacent panels are joined by the hinge assembly having an axis of rotation substantially coplanar with the back sheet section.

29. The multiple panel of claim 28 wherein the male shape and the female shape cooperate to provide front side finger protection and the rearwardly projecting rim and the rib cooperate to provide backside finger protection upon articulation of the opposed garage door panels from a straight angle to a lesser angle.

30. The multiple panel door construction of claim 27 wherein the core region contains an insulating material.

31. A multiple panel door construction comprising, in combination:

a first and second garage door panels hinged together by a hinge assembly having an axis of rotation about a hinge joint, the garage door panels including a front sheet section and a back sheet section defining a core region between the sheet sections containing insulating material, the front sheet section and the back sheet section forming a shaped upper horizontal edge surface in the first garage door panel and a shaped lower horizontal edge surface in the second garage door panel, a first thermally insulating, non-conductive member located along the upper horizontal surface and positioned between the front sheet section and the back sheet section, a second thermally insulating, non-conductive member located along the lower horizontal surface and positioned between the front sheet section and the back sheet section;

a rearwardly projecting rim formed in the upper horizontal edge surface of the back sheet section;

an overlapping rib formed in the lower horizontal edge surface of the back sheet section, whereby the overlapping rib extends into a gap between the hinge joint and the rearwardly projecting rim when the garage door panels are in a closed position.

32. The multiple panel construction of claim 31 wherein the first garage door panel is hinged to the second garage door panel by a hinge assembly having an axis of rotation substantially coplanar with the back sheet section.

33. The multiple panel construction of claim 31 wherein the front sheet section or the back sheet section or both sections are formed sheet metal.

* * * * *

UNITED STATES PATENT AND TRADEMARK OFFICE

CERTIFICATE OF CORRECTION

PATENT NO. : 6,578,619 B2 
DATED : June 17, 2003
INVENTOR(S) : Kevin E. Wright and William F. Kendall It is certified that error appears in the above-identified patent and that said Letters Patent is hereby corrected as shown below:

Title page,
Item [75], Inventors, please delete the names of the inventors and insert therefor:
-- Kevin E. Wright, William F. Kendall, both of Dixon, IL (US) --

Signed and Sealed this

Seventh Day of October, 2003

JAMES E. ROGAN
*Director of the United States Patent and Trademark Office*